US010137712B2

(12) United States Patent
Horie

(10) Patent No.: US 10,137,712 B2
(45) Date of Patent: Nov. 27, 2018

(54) RECORDING DEVICE

(71) Applicant: SEIKO EPSON CORPORATION, Tokyo (JP)

(72) Inventor: Seijun Horie, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/492,401

(22) Filed: Apr. 20, 2017

(65) Prior Publication Data

US 2017/0217227 A1 Aug. 3, 2017

Related U.S. Application Data

(63) Continuation of application No. 14/223,182, filed on Mar. 24, 2014.

(30) Foreign Application Priority Data

Mar. 29, 2013 (JP) ..... 2013-071628

(51) Int. Cl.
*B41J 15/04* (2006.01)

(52) U.S. Cl.
CPC ..... *B41J 15/042* (2013.01)

(58) Field of Classification Search
USPC ..... 347/104; 242/560.2; 399/110
See application file for complete search history.

(56) References Cited

U.S. PATENT DOCUMENTS

| | | | |
|---|---|---|---|
| 5,134,915 | A | 8/1992 | Fukano et al. |
| 5,281,991 | A | 1/1994 | Oonishi et al. |
| 6,661,984 | B2 | 12/2003 | Kojima |
| 7,894,763 | B2 | 2/2011 | Itoh et al. |
| 8,348,417 | B2 | 1/2013 | Yamaya |
| 8,540,362 | B2 | 9/2013 | Yamaya |
| 9,120,338 | B2 | 9/2015 | Yamaya |
| 2011/0064497 | A1 | 3/2011 | Niihara et al. |
| 2011/0216140 | A1 | 9/2011 | Yamaya |

FOREIGN PATENT DOCUMENTS

| | | | |
|---|---|---|---|
| JP | 64-028150 | A | 1/1989 |
| JP | 2000-289896 | A | 10/2000 |
| JP | 2007-076653 | A | 3/2007 |
| JP | 2007-084199 | A | 4/2007 |
| JP | 2012-166915 | A | 9/2012 |

*Primary Examiner* — Lam Nguyen

(57) ABSTRACT

A recording device includes a recording unit and a medium support unit. The recording unit includes a recording head and a platen that faces the recording head in a first direction. The medium support unit is arranged below the recording unit such that the medium support unit overlaps the recording unit as viewed in the first direction. The medium support unit is configured to move, relative to the recording unit, in a second direction perpendicular to the first direction. The medium support unit has an up-down mechanism configured to move a support position of the recording medium upward in the first direction by being pulled from below the recording unit. The support position commences to move upward in the first direction after the medium support unit commences to move in the second direction relative to the recording unit during pulling of the medium support unit.

11 Claims, 9 Drawing Sheets

RECORDING DEVICE

CROSS-REFERENCE TO RELATED APPLICATIONS

This application is a continuation application of U.S. patent application Ser. No. 14/223,182, filed on Mar. 24, 2014. This application claims priority to Japanese Patent Application No. 2013-071628 filed on Mar. 29, 2013. The entire disclosures of U.S. patent application Ser. No. 14/223,182 and Japanese Patent Application No. 2013-071628 are hereby incorporated herein by reference.

BACKGROUND

Technical Field

The present invention relates to a recording device.

Related Art

Among recording devices such as large scale inkjet printers and the like, there are items which perform recording using a recording unit on a sheet form recording medium fed from roll paper mounted in a roll paper holder. In the case of large scale roll paper, there are times when the weight of the roll paper is 10 kg or greater.

The technology noted in Japanese Unexamined Patent Publication No. S64-28150 is an electrophotographic plate making machine, and a pair of arms that support both ends of a master paper to be able to rotate are provided, with the end part of each arm supported to be able to rotate in the vertical direction on a base standing inside a main unit. When performing exposure and development, the master paper supported by the arms is always at the side of the site where exposure and development is being performed.

SUMMARY

However, if the roll paper is always at the side of the recording unit, an installation space is required for the roll paper at the side.

The problem described above is not limited to inkjet printers, but also similarly exists in various recording devices.

Considering the information above, one object of the present invention is to provide a recording device for which it is possible to reduce the installation space of the continuous form recording medium, and to reduce the burden on the user for mounting the continuous form recording medium.

According to one aspect of the invention the recording device includes the recording unit and the medium support unit. The recording unit is configured and arranged to perform recording on a recording medium, and the recording unit includes a recording head and a platen that faces the recording head in a first direction and is configured to support the recording medium. The medium support unit is arranged below the recording unit such that the medium support unit overlaps the recording unit as viewed in the first direction, and the medium support unit is configured and arranged to support the recording medium that is in a continuous form, and to move, relative to the recording unit, in a second direction perpendicular to the first direction. The medium support unit has an up-down mechanism configured and arranged to move a support position of the recording medium upward in the first direction by being pulled from below the recording unit. The support position of the recording medium commences to move upward in the first direction after the medium support unit commences to move in the second direction relative to the recording unit during pulling of the medium support unit.

According to the aspect of the invention, the recording device further includes an upper medium support unit configured and arranged to support a second recording medium that is in a continuous form, arranged above the recording unit, and the recording medium from the medium support unit and the second recording medium from the upper medium support unit are selectively switched to be recorded using the recording unit.

According to the aspect of the invention, the upper medium support unit has a second up-down mechanism configured and arranged to move a support position of the second recording medium downward by being pulled from above the recording unit.

According to the aspect of the invention, the medium support unit has a conveyance mechanism configured and arranged to convey the recording medium to the recording unit.

BRIEF DESCRIPTION OF THE DRAWINGS

Referring now to the attached drawings which form a part of this original disclosure.

DETAILED DESCRIPTION OF EXEMPLARY EMBODIMENTS

Following, we will describe embodiments of the present invention. Of course, the embodiments hereafter are merely showing examples of the present invention, and all of the features shown with the embodiments are not necessarily required for the means for resolving the problems.

Figure 1A:
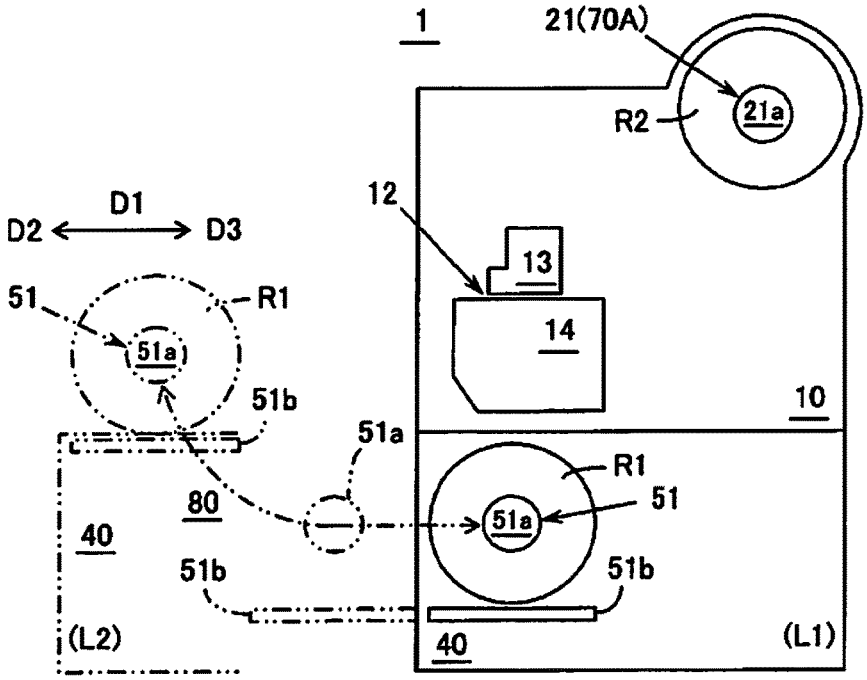
FIGS. 1A and 1B are vertical cross section diagrams showing an example of the operation of the paper feed unit (medium support unit) with which an up-down mechanism 80 is provided.
Figure 1B:
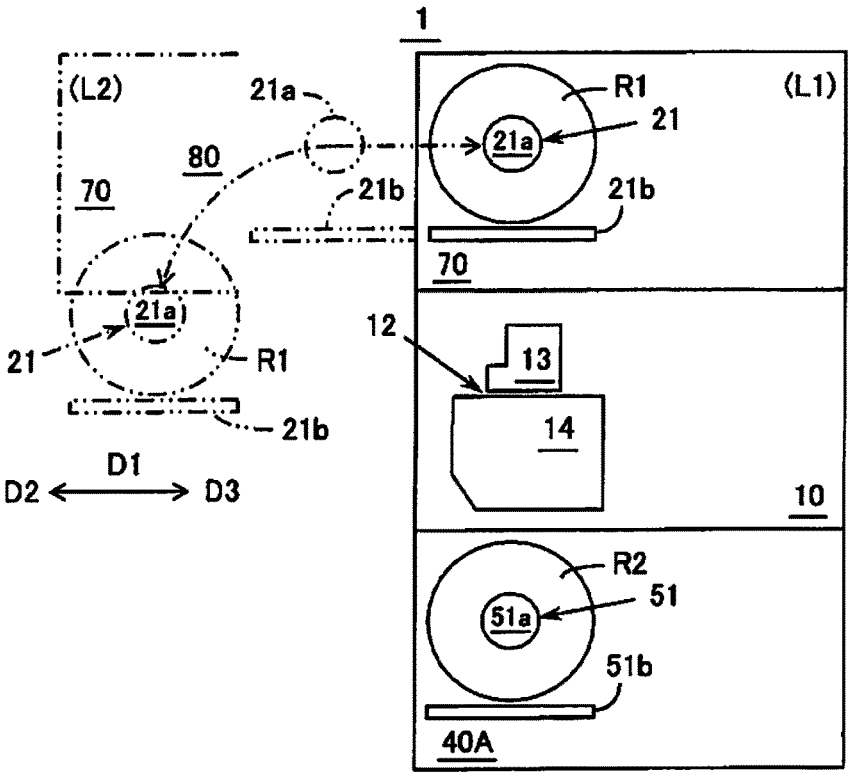
Figure 2:
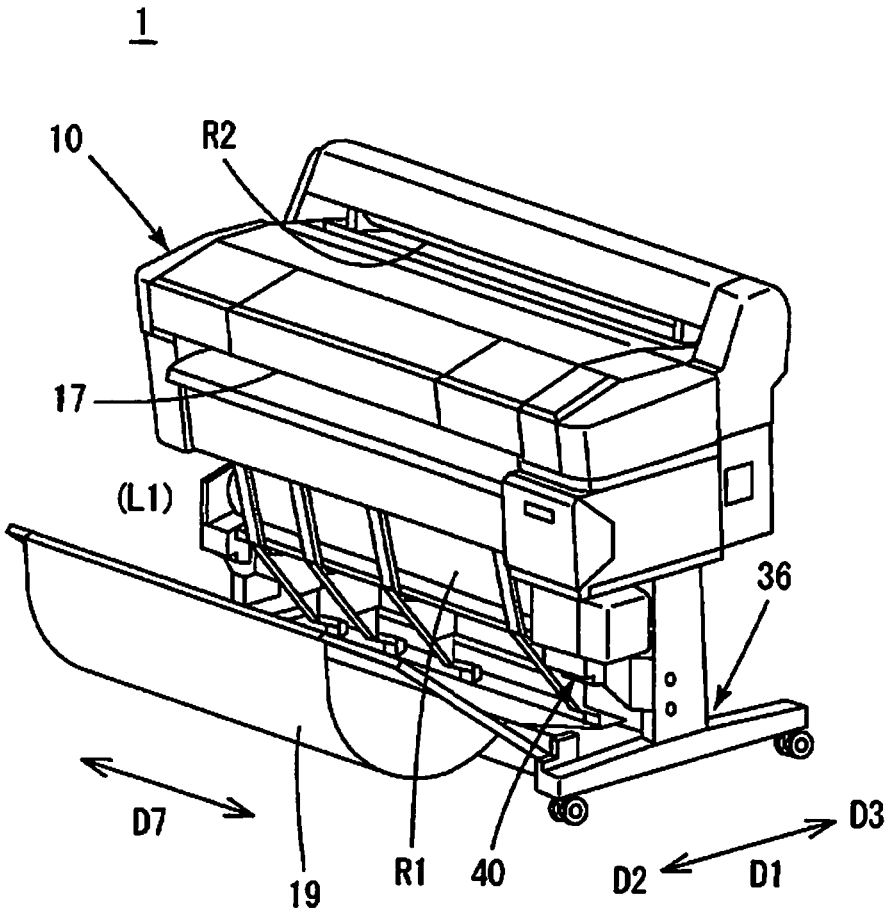
FIG. 2 is a perspective view showing an example of the external appearance of a recording device 1.
Figure 3:
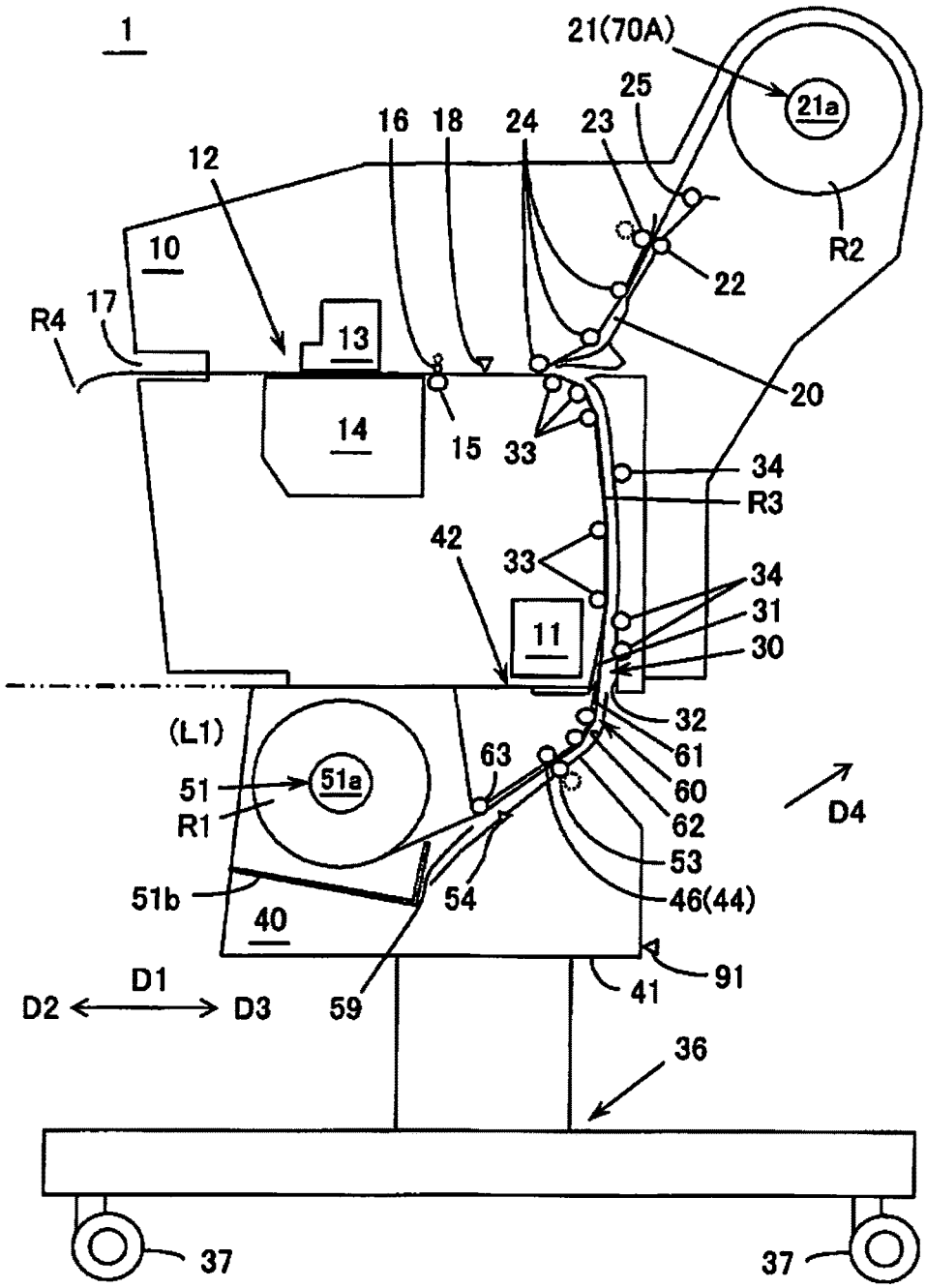
FIG. 3 is a vertical cross section diagram showing an example of the recording device 1 in a state with the paper feed unit 40 housed.
Figure 4:
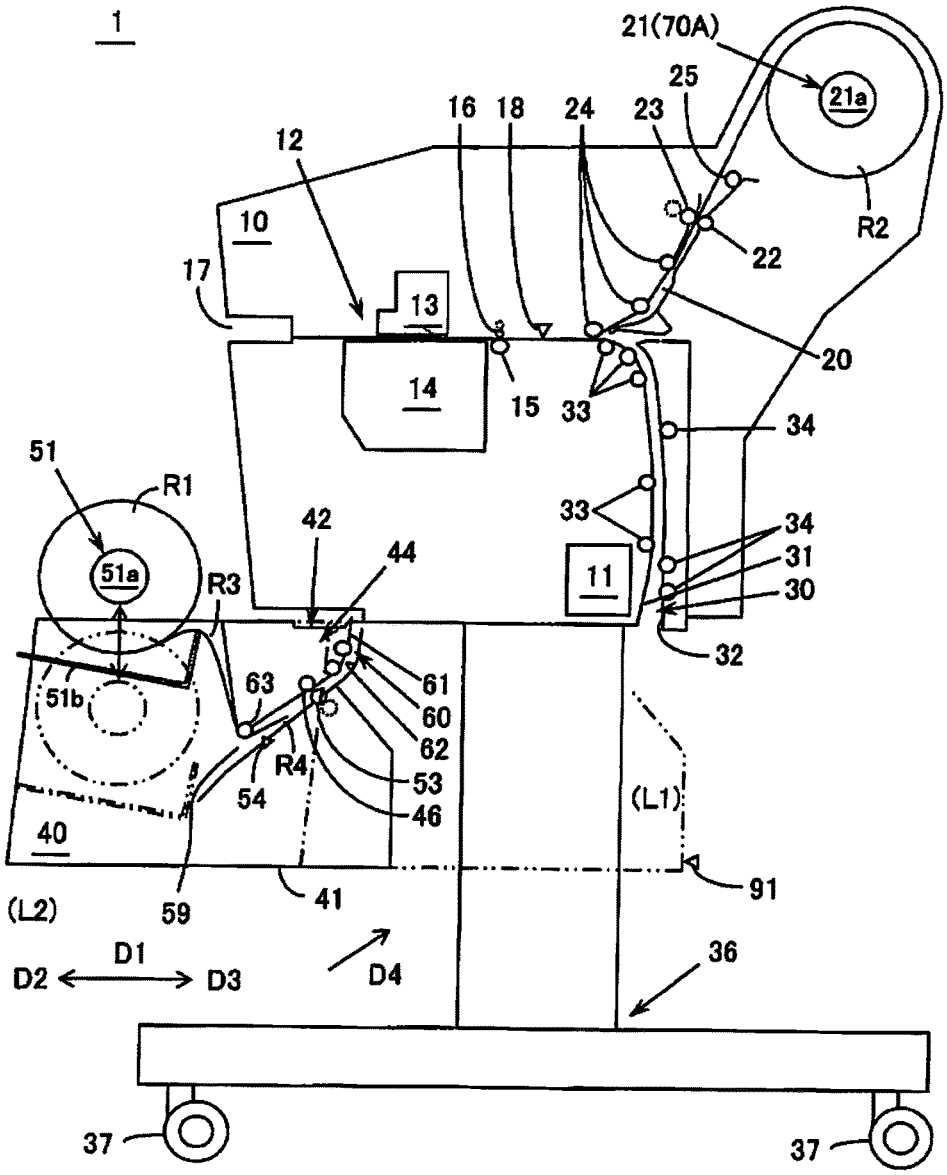
FIG. 4 is a vertical cross section showing an example of the recording device 1 in a state with the paper feed unit 40 pulled out.

FIG. 1A is a vertical cross section diagram for describing the operation of the paper feed unit (medium support unit) 40 below the recording unit 12. FIG. 1B is a vertical cross section diagram for describing the operation of the paper feed unit (medium support unit) 70 above the recording unit 12. FIG. 2 is a perspective view showing the external appearance of a large scale inkjet printer as an example of the recording device 1. FIGS. 3 and 4 are vertical cross section diagrams showing the recording device 1 with the stacker 19 omitted, where FIG. 3 shows the state when the paper feed unit 40 is in a designated housing position L1, and FIG. 4 shows the state when the paper feed unit 40 is in a designated pulling position L2. The housing position L1 is the position that the recording medium R3 passes through in the medium path 30 and 60, and is the position by which the recording medium R3 is conveyed to the recording unit 12.

In the drawings described above, the code D1 indicates the slide direction of the paper feed unit 40 in relation to the main unit 10. The code D2 indicates the pulling direction which is one side of the slide direction D1, facing from the housing position L1 to the pulling position L2. The code D3 indicates the housing direction which is the other side of the slide direction D1, facing from the pulling position L2 to the housing position L1. The code D4 is the conveyance direction of the recording medium R3 fed from the roll paper R1, and the conveyance direction D4 in the drawing crosses the slide direction D1. The code D7 is the width direction of the recording medium R3, and in the example in the drawing, indicates the recording device width direction orthogonal to the slide direction D1 and the conveyance direction D4. FIGS. 1, 3, and 4 are drawings with a lateral view of the recording device 1 from the outside of the width direction D7.

To make this easier to understand, there are cases when the drawings are not consistent.

Also, the positional relationship described with this specification is merely showing an example for describing the invention, and the invention is not limited to that. Therefore, arranging the ejection unit at a position other than the front surface of the main unit, for example the back surface, top, and bottom positions is also included in the present invention.

The recording device 1 shown in the drawing described above is equipped with a main unit 10 having a recording unit 12, and a paper feed unit 40 provided to be able to move relative to this main unit 10, and it is possible to switch between the lower roll paper of the device lower part and the upper roll paper of the device upper interior and do printing (perform recording). We will describe this in detail later, but when pulling the paper feed unit 40 of the low position like that shown in FIG. 1A, the support position (holder 51*a*) of the roll paper R1 moves upward, and when pulling the paper feed unit 40 of a high position like that shown in FIG. 1B, the support position (holder 21*a*) of the roll paper R1 moves downward. By doing this, it is possible to reduce the burden on the user of mounting the roll paper, and the recording device becomes compact during housing of the paper feed unit. The roll paper is continuous paper with a sheet rolled into roll form. Both roll papers R1 and R2 have the outside as the printing surface. Of course, if the positions of the feeding mechanisms 51 and 21 are changed, it is also possible to use roll paper with the inside as the printing surface. For the roll paper, it is possible to use a recording medium with various materials rolled, such as paper, cloth, a plastic sheet, leather or the like.

The main unit 10 shown in FIG. 3 and the like is equipped with a control unit 11, the recording unit 12, a pair of conveyance rollers (15, 16), an ejection unit 17, a cutter 18, a stacker 19, a medium path 20 and paper feed mechanisms (21 to 25) for the upper roll paper, and a first medium path 30 and rolling rollers (driven rollers) 33 and 34 for the lower roll paper, and the like. Also, the main unit 10 is supported on a leg part 36 with a caster 37.

The control unit 11 has a CPU (Central Processing Unit), a ROM (Read Only Memory), a RAM (Random Access Memory) and the like, and controls the operation of each part of the recording device 1 such as by receiving a recording output command from an external host device to print on the recording medium or the like. The recording medium that is subject to printing is the part pulled from one of the roll papers R1 or R2, and with the example shown in FIG. 3, is the continuous sheet from recording medium R3.

The recording unit 12 has a recording head 13 and a platen 14, and prints on the recording medium that passed through the medium path. The recording head 13 is arranged on the top side facing opposite the platen 14, and can record by spraying ink on the recording medium. The platen 14 supports the recording medium, and sets a designated distance between the recording medium and the recording head 13.

The pair of conveyance rollers (15 and 16) is equipped with a drive roller 15 arranged on the lower side, and a driven roller 16 arranged at the upper side. The driven roller 16 can be separated from the drive roller 15, and when nearby, sandwiches the recording medium with the drive roller 15.

The recording medium sent from the ejection unit 17 is cut by the cutter 18, and when it is released from the sandwiching of the pair of conveyance rollers (15, 16), is stacked in the stacker 19.

The paper feed mechanism for the upper roll paper is equipped with a feeding mechanism 21 for supporting the upper roll paper R2, a pair of paper feed rollers (22, 23), rolling rollers (driven rollers) 24 and 25 and the like. The pair of paper feed rollers (22, 23) is equipped with a drive roller 22 arranged at the housing direction D3 side, and a driven roller 23 arranged at the pulling direction D2 side. The driven roller 23 can be separated from the driver roller 22, and when nearby, sandwiches the recording medium with the drive roller 22.

When feeding a new roll paper R2 mounted in the roll paper holder of the feeding mechanism 21, the user first inputs the tip part of the roll paper R2 between the pair of paper feed rollers (22, 23). After that, the feeding mechanism 21 feeds the roll paper R2 and the fed recording medium is sandwiched by the pair of paper feed rollers (22, 23), this is conveyed to the pair of conveyance rollers (15, 16), and the pair of conveyance rollers (15, 16) sandwiches the recording medium. During printing, the pair of conveyance rollers (15, 16) conveys the recording medium onto the platen 14, the recording head 13 sprays ink, and recording is performed on the recording medium.

When the terminal end of the lower roll paper R1 is ejected, if the upper roll paper R2 is fed, it is possible to switch from the lower roll paper R1 to the upper roll paper R2 and perform recording by the recording unit 12.

The first medium path 30 for passing through the recording medium R3 conveyed to the recording unit 12 has a first one side wall part 31 of the pulling direction D2 side for which the rolling roller 33 is provided, and a first other side wall part 32 of the housing direction D3 side on which the rolling roller 34 is provided.

The paper feed unit (medium support unit) 40 that supports the first roll paper (continuous form recording medium) R1 is equipped with a second medium path 60 that passes through the recording medium R3 supplied to a supply port 59, paper feed mechanisms (42, 51, 53, 54), an up-down mechanism 80 and the like. Each of these parts is housed in an external case 41. The paper feed unit 40 is arranged below the recording unit 12, can slide between the housing position L1 and the pulling position L2, and is electrically connected to the control unit 11. The recording device 1 is equipped with a position detection sensor 91 for detecting whether or not the paper feed unit 40 is in the housing position L1, and when it was not detected that the paper feed unit 40 is in the housing position L1, the automatic paper feed operation is made not to be performed.

The second medium path 50 for passing through the recording medium R3 being conveyed to the first medium path 30 has a second one side wall part 61 on the pulling direction D2 side, and a second other side wall part 62 of the housing direction D3 side. The second one side wall part 61 becomes the inside part of the second medium path 60 bent from the feeding mechanism 51, and is provided with a rolling roller (driven roller) 63.

The paper feed mechanism for the lower roll paper is equipped with a mechanism unit 42 having a conveyance mechanism 44, a driven roller 53, a medium detection sensor 54, a feeding mechanism 51 having a holder 51*a* and a platform 51*b*, and the like.

The conveyance mechanism 44 is constituted by a drive roller 46 constituting one of the rollers of the pair of paper feed rollers (46, 53), a servo motor that does rotational driving of this drive roller 46, and the like. The driven roller 53 constitutes the other roller of the pair of paper feed rollers (46, 53). The driven roller 53 can be separated from the drive roller 46, and when nearby, sandwiches the recording medium R3 with the drive roller 46. The medium detection sensor 54 detects the presence or absence of the recording medium R3 inside the medium path 60. When the medium detection sensor 54 detects the existence of the recording medium R3, the recording medium R3 is automatically conveyed. Holders 51*a* re provided respectively at the position of both end parts of the roll paper R1, and sandwich both end parts of the roll paper R1. The platform 51*b* can have the roll paper R1 mounted in the holders 51*a* placed on it. The holders 51*a* and the platform 51*b* are fixed to each other.

The up-down mechanism 80 shown in FIG. 4 moves the support position (holder 51*a*) of the roll paper R1 upward by the paper feed unit 40 being pulled from below the recording unit 12.

Figure 9:
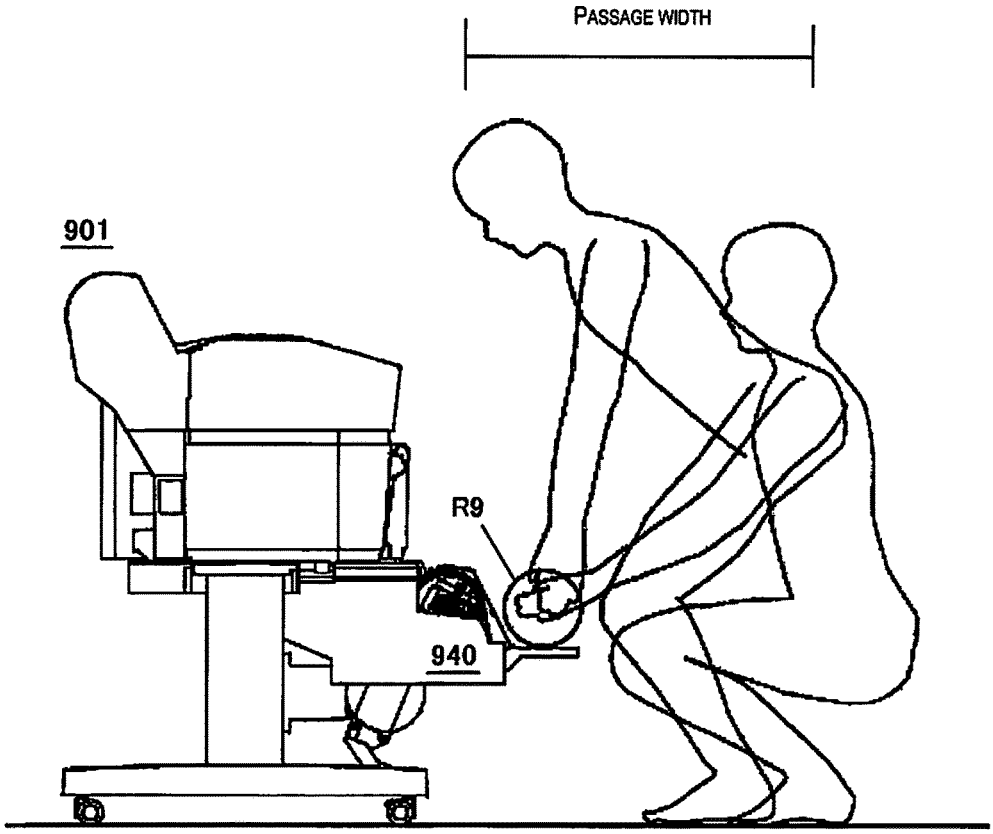
FIG. 9 is a drawing showing a mounted state of the roll paper R9 with a comparison example.

However, when the up-down mechanism 80 noted above does not exist, as with a recording device 901 of the comparison example shown in FIG. 9, a paper feed unit 940 pulled from below the recording unit is left at a low position. When the roll paper R9 is heavy, when an attempt is made to mount the roll paper R9 in the paper feed unit 940, the user has to bend his body a great deal, so there is a possibility of placing a great burden on the user's back or the like. Also, when the space of the pulling side of the paper feed unit 940 (e.g. the path width) is narrow, it may be difficult to do work with significant bending of the body.

In light of that, this recording device 1 is made to move upward when the paper feed unit 40 is pulled from below the recording unit 12, and the burden on the user for mounting the roll paper R1 is reduced, improving ease of use.

First, we will describe the recording device 1 shown in FIG. 1A. The paper feed unit 40 of this recording device 1 is arranged below the recording unit 12, supports the roll paper R1, and is able to move relative to the slide direction D1 in relation to the recording unit 12. The up-down mechanism 80 of this recording device 1 moves the support position (holder 51*a*) of the roll paper R1 upward when the paper feed unit 40 is pulled, and reduces the burden on the user. Also, the up-down mechanism 80 moves the support position (51*a*) of the roll paper R1 downward by the paper feed unit 40 being housed below the recording unit 12. Therefore, with this recording device 1, it is possible to reduce the roll paper installation space, and it is possible to reduce the burden on the user for mounting the roll paper.

When the user mounts a new roll paper R1 in the paper feed unit 40 at the pulling position L2, as shown in FIG. 4, the tip part R4 of the roll paper R1 is input to the supply port 59. After that, when the user pushes the paper feed unit 40 in the housing direction D3, the up-down mechanism 80 moves the support position (51*a*) of the roll paper R1 downward. By doing this, the paper feed unit 40 is housed in the housing position L1 below the recording unit 12 as shown in FIG. 3. Also, when the existence of the recording medium R3 within the medium path 60 is detected by the medium detection sensor 54, the feeding mechanism 51 feeds the roll paper R1, and the fed recording medium R3 is sandwiched by the pair of paper feed rollers (46, 53) within the second medium path 60 and conveyed to the first medium path 30. Then, the recording medium R3 that passed through the first medium path 40 and was conveyed to between the pair of conveyance rollers (15, 16) is sandwiched by the pair of conveyance rollers (15, 16). After that, the pair of paper feed rollers (46, 53) can also release the recording medium R3 from sandwiching. Up to this point is the automatic paper feed operation of the recording medium R3 being sent to the recording unit 12 by the conveyance mechanism 44. During printing (during recording), the pair of conveyance rollers (15, 16) conveys the recording medium R3 onto the platen 14, the recording head 13 sprays ink, and performs recording on the recording medium R3. This series of operations is controlled by the control unit 11.

If the lower roll paper R1 is fed when the terminal end of the upper roll paper R2 is ejected, it is possible to switch from the upper roll paper R2 to the lower roll paper R1 and perform recording with the recording unit 12.

Here, if the automatic paper feeding mechanism noted above does not exist, it is necessary to do the manual work of doing paper feeding from the low position to the recording unit which is a big burden on the user. This recording device 1 sends the recording medium fed from the roll paper when the paper feed unit is housed to the recording unit, so the work of supplying the recording medium from the paper feed unit to the recording unit is reduced.

The recording device 1 shown in FIG. 1A is further equipped with a feeding mechanism 21 having a holder 21*a* for a second roll paper (second recording medium) R2. This feeding mechanism 21 is an upper medium support unit 70A arranged above the recording unit 12, and supports the continuous form second recording medium (second roll paper R2). The recording device 1 can switch between the recording medium from the paper feed unit 40 (first roll paper R1) and the second recording medium from the upper medium support unit 70A (second roll paper R2) and have recording performed by the recording unit 12. There is a continuous form recording medium both above and below the recording unit 12, so this recording device 1 is capable of recording a large capacity in a small space.

The concept described above can also be applied when the paper feed unit is arranged above the recording unit. The paper feed unit 70 of the recording unit 1 shown in FIG. 1B is arranged above the recording unit 12, supports the roll paper R1, and is able to move relative to the slide direction D1 in relation to the recording unit 12. The up-down mechanism 80 of this recording device 1 moves the support position (holder 21*a*) of the roll paper R1 downward when pulling the paper feed unit 70, and the burden on the user is reduced. The feeding mechanism 21 of the paper feed unit 70 has the holder 21*a* and the platform 21*b* fixed to each other. The holders 21*a* are provided respectively at positions on both end parts of the roll paper R1, and support both end parts of the roll paper R1. The platform 21*b* can have the roll paper R1 mounted in the holders 21*a* placed on it.

Also, the up-down mechanism 80 moves the support position (21*a*) of the roll paper R1 upward by the paper feed unit 70 being housed above the recording unit 12. Therefore, this recording device 1 is able to reduce the installation space of the roll paper, and can reduce the burden on the user for mounting the roll paper.

The recording device 1 shown in FIG. 1B is further equipped with a feeding mechanism 51 having a holder 51*a* for the second roll paper (second recording medium) R2. This feeding mechanism 51 is the lower medium support unit 40A arranged below the recording unit 12, and supports the continuous form second recording medium (second roll paper R2). The recording device 1 is able to switch between the recording medium from the paper feed unit 70 (first roll paper R1) and the second recording medium from the lower medium support unit 40A (second roll paper R2), and record using the recording unit 12. There is a continuous form recording medium both above and below the recording unit 12, so this recording device 1 is capable of large capacity recording in a small space.

The lower medium support unit 40A can also have a second up-down mechanism that moves the support position (holder 51*a*) of the second roll paper R2 upward by pulling from below the recording unit 12. Of course, for the upper medium support unit 70A shown in FIG. 1A as well, it is also possible to have a second up-down mechanism that moves the support position (holder 21*a*) of the second roll paper R2 downward by pulling from above the recording unit 12.

Next, we will describe a specific example of the up-down mechanism 80.

Figure 5:
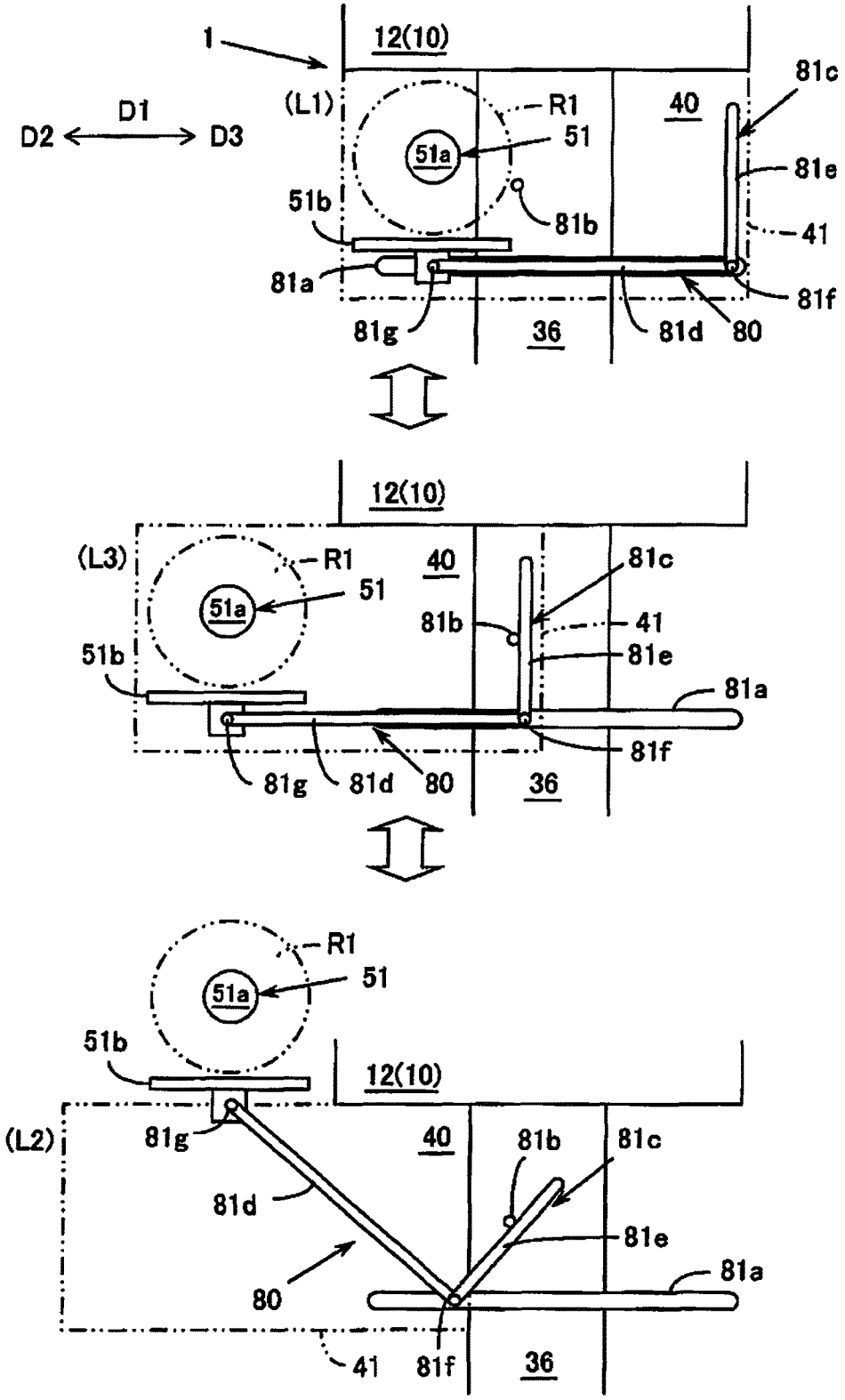
FIG. 5 is a drawing showing an example of the up-down mechanism that uses the principle of leverage.

FIG. 5 is a vertical cross section diagram showing an example of the up-down mechanism 80 that uses the principle of leverage. To make it easier to understand, the external case 41 is see through. The up-down mechanism 80 shown in FIG. 5 is equipped with a groove part 81*a* and a convex part 81*b* provided at a site for which the relative position does not change on the recording unit 12, and a lever member 81*c*. The groove part 81*a* is formed by a member for which the lengthwise direction is attached facing the slide direction D1, for example, to the surface of the inside of the width direction D7 (see FIG. 2) of the leg part 36. The convex part 81*b* is formed so as to project above the groove part 81*a*, for example, to the inside of the width direction D7 from the surface of the inside of the width direction D7 of the leg part 36. The lever member 81*c* is equipped with a slide direction part 81*d*, an intersecting part 81*e*, a slider 81*f*, and a shaft support part 81*g*, and is housed in the external case 41. The slide direction part 81*d* is arranged with the lengthwise direction facing the slide direction D1 when the paper feed unit 40 is in the housing position L1. The intersecting part 81*e* has its lengthwise direction facing the direction roughly orthogonal (intersecting) to the lengthwise direction of the slide direction part 81*d*. The slide direction part 81*d* and the intersecting part 81*e* are fixed to each other. The slider 81*f* is fixed to the connecting part of the slide direction part 81*d* and the intersecting part 81*e*, is inserted in the groove part 81*a* piercing through a through hole formed on the external case 41, and is able to slide and move along the groove part 81*a*. Therefore, the slider 81*f* is supported to be able to rotate with the width direction D7 as the center axis on the external case 41, and the lever member 81*c* is provided to be able to rotate with the slider 81*f* as the center axis on the external case 41. The shaft support part 81*g* is provided on the end part of the pulling direction D2 of the slide direction part 81*d*, and is attached to be able to rotate with the width direction D7 as the rotation axis on the platform 51*b*.

When the paper feed unit 40 in the housing position L1 is pulled in the pulling direction D2, the holder 51*a* and the platform 51*b* do not rise to the position L3 at which the intersecting part 81*e* contacts the convex part 81*b*. Therefore, the feeding mechanism 51 and the main unit 10 do not interfere with each other. After the intersecting part 81*e* contacts the convex part 81*b* as shown in the middle level of FIG. 5, while the slider 81*f* slides and moves in the pulling direction D2, the convex part 81*b* is left in contact with the intersecting part 81*e*, so the lever member 81*c* rotates to the right in FIG. 5 using the principle of leverage. By doing this, as shown in the lower level of FIG. 5, the holder 51*a* and the platform 51*b* rise in tandem with pulling of the paper feed unit 40. Therefore, the burden on the user for mounting the roll paper R1 in the holder 51*a* is reduced.

After the roll paper R1 is mounted, when the paper feed unit 40 in the pulling position L2 is pushed in the housing direction D3, while the intersecting part 81*e* is in contact with the convex part 81*b*, the lever member 81*c* works in tandem with the sliding movement of the paper feed unit 40 by the weight of the platform 51*b* and the like and rotates to the left in FIG. 5. By doing this, the holder 51*a* and the platform 51*b* fall. After the intersecting part 81*e* has separated from the convex part 81*b*, the holder 51*a* and the platform 51*b* do not fall, and are housed in the paper feed unit 40 at the housing position L1. Therefore, a small amount of space is sufficient for installing the roll paper R1.

Figure 6:
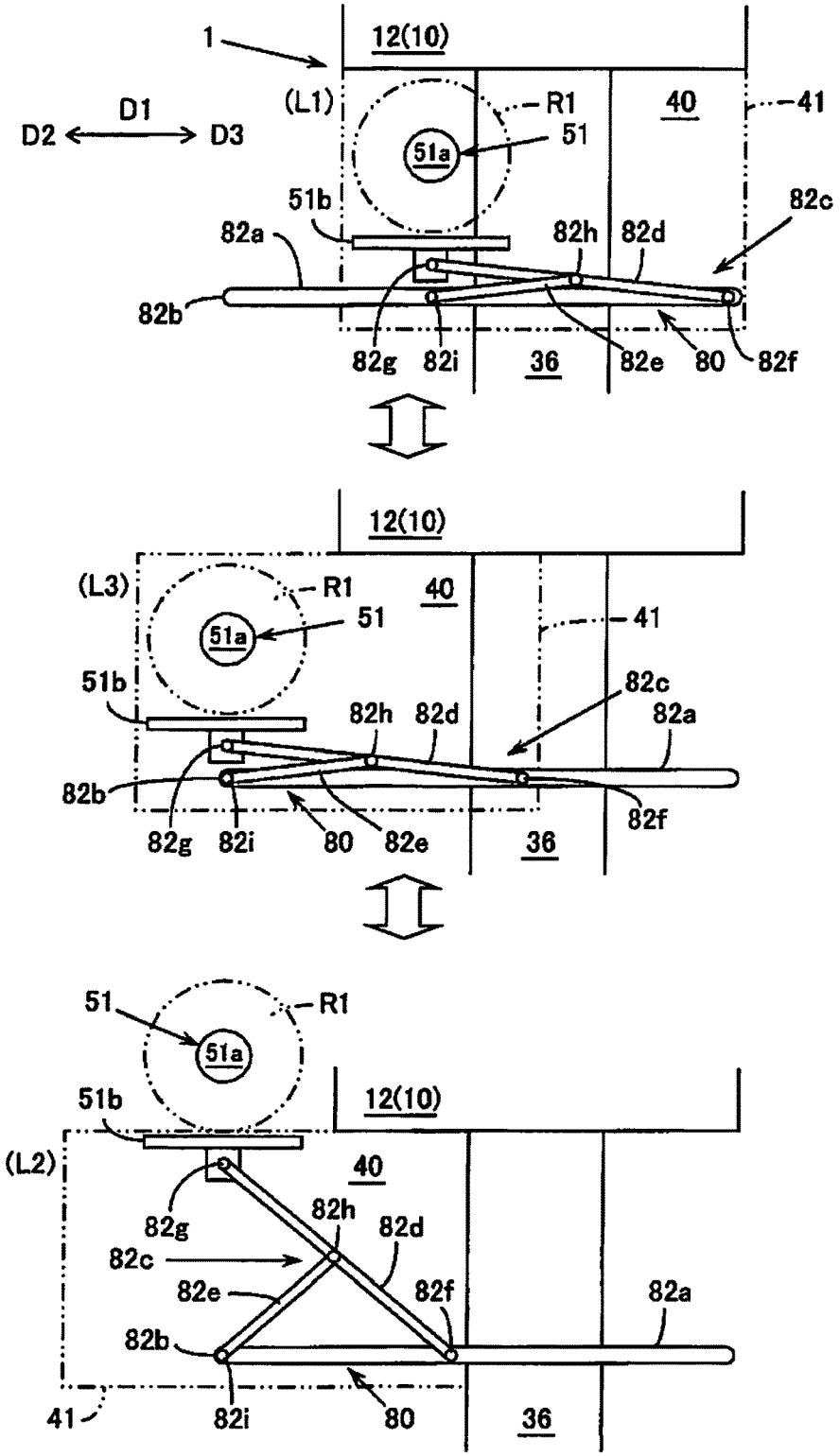
FIG. 6 is a drawing showing an example of the up-down mechanism using a Scott Russell linking mechanism.

FIG. 6 shows an example of the up-down mechanism using a Scott Russell linking mechanism. To make it easier to understand, the external case 41 is see through. The up-down mechanism 80 shown in FIG. 6 is equipped with a groove part 82*a* provided at a site for which the relative position to the recording unit 12 does not change, and a linking member 82*c*. The groove part 82*a* is formed with a member attached with the lengthwise direction facing the slide direction D1, for example to the surface of the inside of the width direction D7 (see FIG. 2) on the leg part 36. The linking member 82*c* is equipped with rod members 82*d* and 82*e*, sliders 82*f* and 82*i*, shaft support part 82*g*, and connecting part 82*h*, and is housed in the external case 41. The relatively long rod member 82*d* and the rod member 82*e* shorter than the rod member 82*d* are arranged facing a direction for which the lengthwise direction is relatively close to the slide direction D1 when the paper feed unit 40 is in the housing position L1. The connecting part 82*h* that is at the end part of the housing direction D3 side of the rod member 82*e* is connected to be able to rotate with the width direction D7 as the center axis at roughly the center position of the rod member 82*d*. The slider 82*f* is fixed to the end part of the housing direction D3 side of the long rod member 82*d*, is inserted in the groove part 82*a* piercing through the through hole formed in the external case 41, and is able to move sliding along the groove part 82*a*. Therefore, the slider 82*f* is supported to be able to rotate with the width direction D7 as the center axis on the external case 41. The shaft support part 82*g* is provided at the end part of the pulling direction D2 side of the long rod member 82*d*, and is attached to be able to rotate with the width direction D7 as the rotation axis on the platform 51*b*. The slider 82*i* is fixed to the end part of the pulling direction D2 side of the short rod member 82*e*, is inserted in the groove part 82*a* piercing through the long hole formed on the external case 41, and is able to move sliding along the groove part 82*a*. The long hole of the external case 41 is formed with the lengthwise direction facing the slide direction D1, and when the slider

82*i* is between the position L3 that abuts the groove part 82*a* pulling side end part 82*b* when the paper feed unit 40 is pulled and the housing position L1, the slider 82*i* moves relative to the slide direction D1 on the external case 41.

When the paper feed unit 40 in the housing position L1 is pulled in the pulling direction D2, the holder 51*a* and the platform 51*b* do not rise to the position L3 at which the slider 82*i* abuts the groove part 82*a* pulling side end part 82*b*. Therefore, the feeding mechanism 51 and the main unit 10 do not interfere with each other. As shown in the middle level of FIG. 6, after the slider 82*i* abuts the pulling side end part 82*b*, using the Scott Russell linking mechanism, as shown in the bottom level of FIG. 6, the holder 51*a* and the platform 51*b* rise in tandem with the paper feed unit 40 being pulled. Therefore, the burden on the user for mounting the roll paper R1 in the holder 51*a* is reduced.

After the roll paper R1 is mounted, when the paper feed unit 40 in the pulling position L2 is pushed in the housing direction D3, after a while in a state with the slider 82*i* abutting the pulling side end part 82*b* by the weight of the platform 51*b* or the like, the holder 51*a* and the platform 51*b* work in tandem with the sliding movement of the paper feed unit 40 and fall. After the slider 82*i* separates from the pulling side end part 82*b*, the holder 51*a* and the platform 51*b* do not fall, and the paper feed unit 40 is housed in the housing position L1. Therefore, a small installation space for the roll paper R1 is sufficient.

The linking mechanism can also be a linking mechanism other than the Scott Russell linking mechanism.

Figure 7:
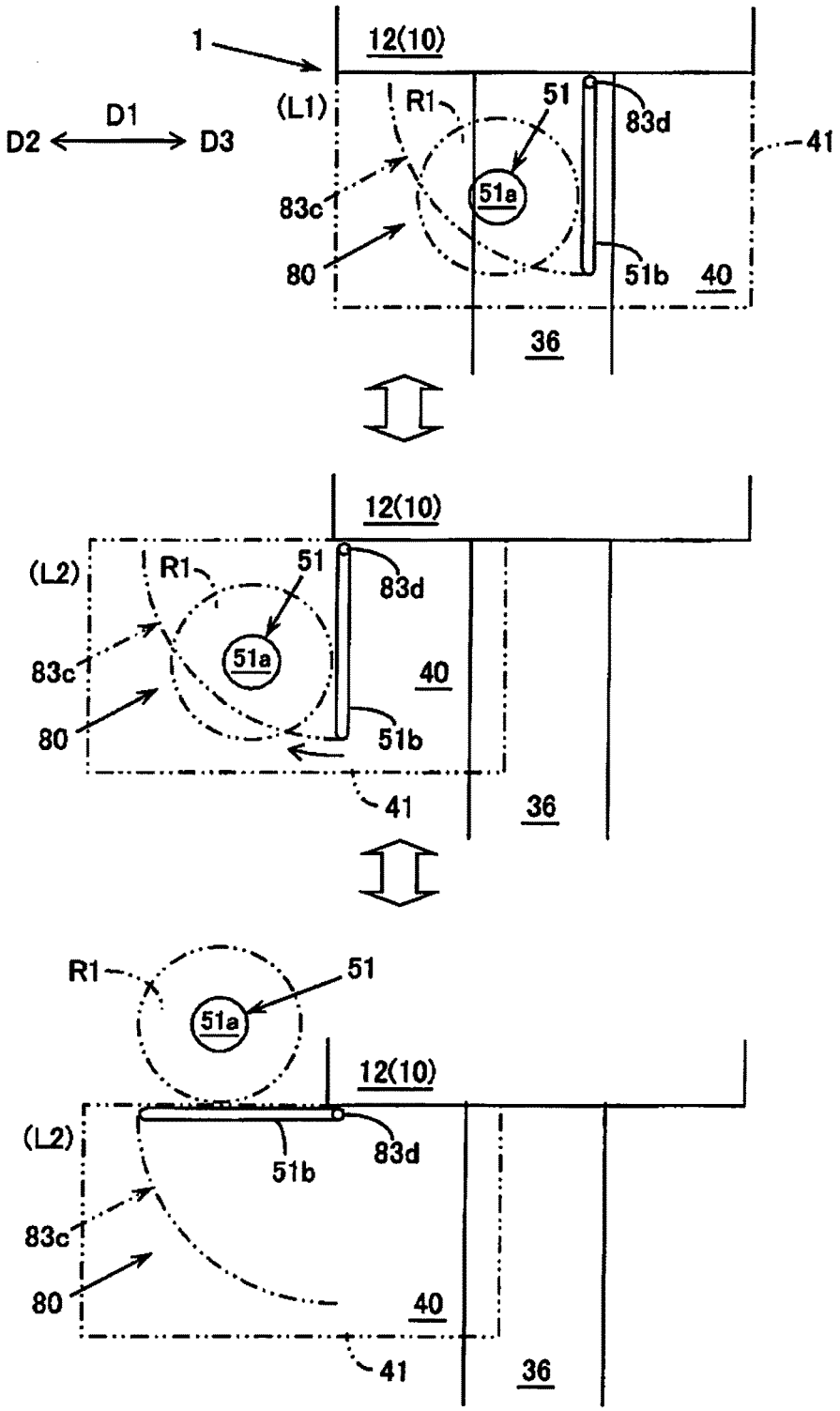
FIG. 7 is a drawing showing an example of the up-down mechanism that uses a rotation mechanism 83*c*.

FIG. 7 shows an example of the up-down mechanism 80 using the rotation mechanism 83*c* of the platform 51*b*. To make it easier to understand, the external case 41 is see through. The up-down mechanism 80 shown in FIG. 7 is equipped with a rotation mechanism 83*c* having a rotation shaft 83*d*. The rotation mechanism 83*c* is housed in the external case 41. The platform 51*b* is arranged roughly perpendicular when the paper feed unit 40 is in the housing position L1, and the rotation shaft 83*d* is provided on the top edge part. This rotation shaft 83*d* is supported to be able to rotate on the external case 41 with the lengthwise direction facing the width direction D7 (see figure). The rotation mechanism 83*c* is also equipped with a roughly perpendicular holding mechanism for holding the platform 51*b* in a roughly perpendicular orientation as shown in the top level of FIG. 7, and a roughly horizontal holding mechanism for holding the platform 51*b* in a roughly horizontal direction as shown in the lower level of FIG. 7.

When the paper feed unit 40 in the housing position L1 is pulled in the pulling direction D2 to the pulling position L2, the holder 51*a* and the platform 51*b* do not rise. Therefore, the feeding mechanism 51 and the main unit 10 do not interfere with each other. As shown in the middle level of FIG. 7, after the paper feed unit 40 is pulled to the pulling position L2, the holder 51*a* and the platform 51*b* are rotated to the right in FIG. 7 with the rotation shaft 83*d* as the center by the rotation mechanism 83*c*, and as shown in the lower level of FIG. 7, it is possible to raise the holder 51*a* and the platform 51*b* and hold them. The rotation mechanism 83*c* can be an item for which the platform 51*b* is rotated manually, and it can also be an item for which when the paper feed unit 40 being pulled to the pulling position L2 is detected by the position detection sensor, the platform 51*b* is rotated automatically. Either rotation mechanism includes an up-down mechanism by which the support position (holder 51*a*) of the recording medium is moved upward by the paper feed unit 40 being pulled from below the recording unit. With this modification example as well, the burden on the user for mounting the roll paper R1 in the holder 51*a* is reduced.

After the roll paper R1 is mounted, the holder 51*a* and the platform 51*b* are rotated to the left in FIG. 7 with the rotation shaft 83*d* as the center by the rotation mechanism 83*c*, and as shown in the middle level of FIG. 7, it is possible to drop the holder 51*a* and the platform 51*b* and hold them. After that, when the paper feed unit 40 in the pulling position L2 is pushed in the housing direction D3, the paper feed unit 40 is housed at the housing position L1. Therefore, a small installation space for the roll paper R1 is sufficient.

Figure 8:
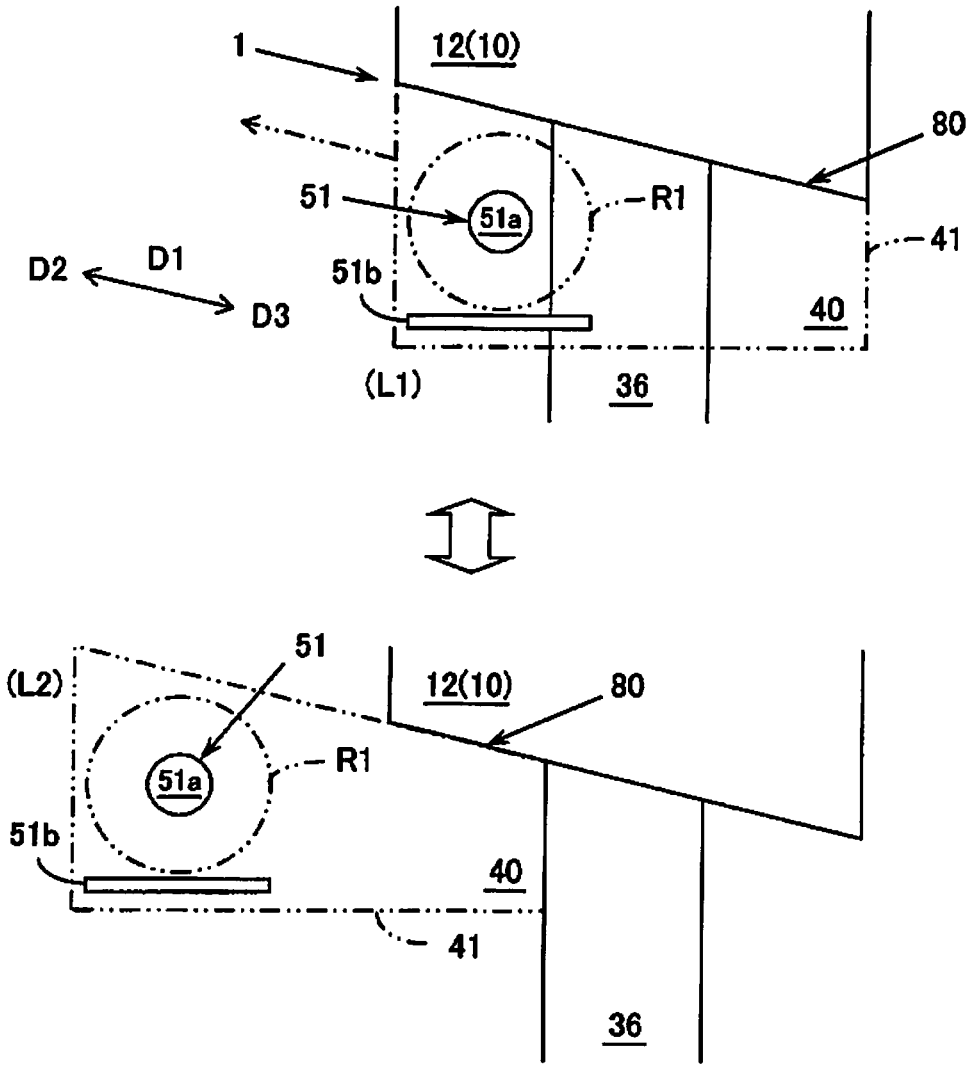
FIG. 8 is a drawing showing an example of the up-down mechanism with the slide direction tilted from the horizontal direction.

FIG. 8 shows an example of the up-down mechanism 80 with the slide direction D1 of the paper feed unit 40 tilted from the horizontal direction. To make this easier to understand, the external case 41 is see through.

When the paper feed unit 40 in the housing position L1 is pulled in the pulling direction D2, as a result of the paper feed unit 40 rising, the holder 51*a* and the platform 51*b* rise. Specifically, the up-down mechanism 80 moves the support position (holder 51*a*) of the recording medium upward by the paper feed unit 40 being pulled from below the recording unit 12. Therefore, with this modification example as well, the burden of the user for mounting the roll paper R1 in the holder 51*a* is reduced.

After the roll paper R1 is mounted, when the paper feed unit 40 in the pulling position L2 is pushed in the housing direction D3, as a result of the paper feed unit 40 falling, the holder 51*a* and the platform 51*b* fall. The paper feed unit 40 is housed in the housing position L1, so a small installation space for the roll paper R1 is sufficient.

With each of the various modification examples described above, there was a paper feed unit below the recording unit, but it is also possible to provide the same kind of up-down mechanism when there is a paper feed unit above the recording unit.

Furthermore, various modification examples are possible for the present invention.

For example, for the recording medium to which the present invention can be applied, in addition to roll paper, it is also possible to use folded continuous paper or the like.

The drive roller and the driven roller constituting the pair of rollers described above can also be arranged with the reverse positional relationship to that described above. Also, it is also possible to constitute the pair of rollers with a pair of drive rollers using a drive roller instead of the driven roller.

The recording device, in addition to being a device that switches between a plurality of media to be recorded to perform recording, can also be a device that performs recording on one recording medium. Of course, it is also possible to provide an up-down mechanism on each medium support unit of a recording device equipped with three or more medium support units that can be pulled. Therefore, it is also possible to provide a plurality of medium support units that can be pulled having an up-down mechanism below the recording unit, and it is possible to provide a plurality of medium support units having an up-down mechanism that can be pulled above the recording unit.

In addition to moving the medium support unit between the housing position and the pulling position without moving the recording unit, it is also possible to move the recording unit between the housing position and the pulling position without moving the medium support unit, and possible to move both the medium support unit and the recording unit between the housing position and the pulling position.

As described above, with the present invention, using various modes, it is possible to reduce the installation space of a continuous form recording medium, and to provide a technology that is able to reduce the burden on the user of mounting the continuous form recording medium. Of course, technology or the like consisting only of the constitutional elements of the independent claims without having the constitutional elements of the dependent claims also can obtain the basic operation and effect described above.

Also, it is also possible to implement constitutions for which the constitutions disclosed in the embodiments and modification examples described above are mutually exchanged, combined, or modified, constitutions for which known technology as well as the constitutions disclosed in the embodiments and modification examples described above are mutually exchanged, combined, or modified, and the like. The present invention includes these constitutions and the like.

A recording device according to one aspect includes a recording unit and a medium support unit. The recording unit is configured and arranged to perform recording on a recording medium. The medium support unit is arranged below the recording unit, and configured and arranged to support the recording medium that is in a continuous form, and to move relative to the recording unit. The medium support unit has an up-down mechanism configured and arranged to move a support position of the recording medium upward by being pulled from below the recording unit.

Specifically, the medium support unit is provided below the recording unit, so only a small amount of installation space is needed for the continuous form recording medium. Here, if an attempt is made to mount a heavy recording medium on the medium support unit which is below the recording unit, there is a possibility of putting a big burden on the user's back or the like, but because the support position of the recording medium is moved upward by the medium support unit being pulled from below the recording unit, the burden on the user is reduced. Therefore, with the mode noted above, it is possible to provide a recording device for which it is possible to reduce the installation space of the continuous form recording medium, and which can reduce the burden of the user when mounting the continuous form recording medium.

In this case, the recording device can also be equipped with an upper medium support unit configured and arranged to support a second recording medium that is in a continuous form, arranged above the recording unit, wherein the recording medium from the medium support unit and the second recording medium from the upper medium support unit are selectively switched to be recorded using the recording unit. This mode can provide a recording device capable of large capacity recording in little space, because the recording medium below and above the recording unit can be switched and recorded.

Also, the upper medium support unit can have a second up-down mechanism configured and arranged to move a support position of the second recording medium downward by being pulled from above the recording unit. This mode can provide a recording device that further improves the ease of use.

A recording device according to another aspect includes a recording unit and a medium support unit. The recording unit is configured and arranged to perform recording on a recording medium. The medium support unit is arranged above the recording unit, and configured and arranged to support the recording medium that is in a continuous form, and to move relative to the recording unit. The medium support unit has an up-down mechanism configured and arranged to move a support position of the recording medium downward by being pulled from above the recording unit.

Specifically, the medium support unit is provided above the recording unit, so a small installation space is sufficient for the continuous form recording medium. Here, if an attempt is made to mount a heavy recording medium on the medium support unit which is above the recording unit, there is a possibility of placing a large burden on the user's shoulders or the like, but by pulling the medium support unit from above the recording unit, the support position of the recording medium is moved downward, so the burden on the user is reduced. Therefore, with the mode noted above, it is possible to provide a recording device for which it is possible to reduce the installation space of the continuous form recording medium, and possible to reduce the burden on the user for mounting the continuous form recording medium.

In this case, the recording device can also be equipped with a lower medium support unit configured and arranged to support a second recording medium that is in a continuous form, arranged below the recording unit, wherein the recording medium from the medium support unit and the second recording medium from the lower medium support unit are selectively switched to be recorded using the recording unit. With this mode, switching is done between the recording medium above and below the recording unit, and recording is done, so it is possible to provide a recording device capable of large capacity recording in a small space.

The lower medium support unit can also have a second up-down mechanism configured and arranged to move a support position of the second recording medium upward by pulling from below the recording unit.

Here, the recording device noted above includes inkjet printers, wire dot printers, laser printers, line printers, copy machines, fax machines and the like.

The continuous form recording medium includes roll form media to be recorded, folded media to be recorded and the like.

However, it is also possible for the medium support unit to have a conveyance mechanism that sends the recording medium to the recording unit. When the medium support unit is returned downward or upward of the recording unit, this may result in a height that is a great burden on the user, but with this mode, the recording medium supported by the medium support unit is sent to the recording unit, so it is possible to reduce the work of supplying the recording medium from the medium support unit to the recording unit.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a recording unit configured and arranged to perform recording on a recording medium, the recording unit including a recording head and a platen that faces the recording head in a first direction and is configured to support the recording medium; and a medium support unit arranged below the recording unit and configured and arranged to support the recording medium that is in a continuous form, the medium support unit being arranged so as to overlap the recording unit as viewed in the first direction while the medium support unit is positioned at a housing position, the medium support unit being configured and arranged to move, relative to the recording unit, along a second direction perpendicular to the first direction from the housing position, the medium support unit including a platform which is configured to support the recording medium from below and on which the recording medium is configured to be placed, and an up-down mechanism configured and arranged to move the platform upward in the first direction by the medium support unit being pulled from below the recording unit, the up-down mechanism being configured and arranged to commence to move the platform upward in the first direction after the medium support unit commences to move in the second direction relative to the recording unit during pulling of the medium support unit.

2. The recording device according to claim 1, further comprising an upper medium support unit configured and arranged to support a second recording medium that is in a continuous form, arranged above the recording unit, wherein the recording medium from the medium support unit and the second recording medium from the upper medium support unit are selectively switched to be recorded using the recording unit.

3. The recording device according to claim 2, wherein the upper medium support unit has a second up-down mechanism configured and arranged to move a support position of the second recording medium downward by being pulled from above the recording unit.

4. The recording device according to claim 1, wherein the medium support unit has a conveyance mechanism configured and arranged to convey the recording medium to the recording unit.

5. The recording device according to claim 1, wherein the up-down mechanism includes a convex part, and a lever member that has a slide direction part configured to slide in the second direction, and an intersecting part arranged so as to intersect with the slide direction part, the intersecting part is configured to contact the convex part in response to the medium support unit being pulled out in the second direction, and configured to rotate in response to contacting the convex part, the slide direction part is configured to slide in the second direction together with the intersecting part, and configured to rotate, and the platform is configured to move upward in the first direction in response to rotation of the slide direction part.

6. The recording device according to claim 1, wherein the up-down mechanism includes a linking member, and the link member has a first rod member and a second rod member that is shorter than the first rod member, a first end of the first rod member is configured to slide in the second direction, a first end of the second rod member is connected to a center of the first rod member so as to rotate relative to the center of the first rod member, the first rod member and the second rod member are configured to rotate in response to the medium support unit being pulled out in the second direction while a second end of the second rod member is stationary, and the platform is configured to move upward in the first direction in response to rotation of the first rod member.

7. The recording device according to claim 1, wherein the up-down mechanism includes a rotation mechanism, and the rotation mechanism has a rotation shaft, one end of the platform is connected to the rotation shaft such that the platform rotates relative to the rotation shaft, and the platform is configured to move upward in the first direction in response to rotation of the platform.

8. A recording device comprising:

a recording unit configured and arranged to perform recording on a recording medium; and a medium support unit arranged below the recording unit, and configured and arranged to support the recording medium that is in a continuous form, and to move relative to the recording unit, wherein the medium support unit has a holder which holds the recording medium, a platform on which the recording medium held by the holder is configured to be placed, and an up-down mechanism configured and arranged to move the holder and the platform upward by the medium support unit being pulled from below the recording unit.

9. The recording device according to claim 8, further comprising an upper medium support unit configured and arranged to support a second recording medium that is in a continuous form, arranged above the recording unit, wherein the recording medium from the medium support unit and the second recording medium from the upper medium support unit are selectively switched to be recorded using the recording unit.

10. The recording device according to claim 9, wherein the upper medium support unit has an upper holder which holds the recording medium, an upper platform on which the recording medium held by the upper holder is configured to be placed, and a second up-down mechanism configured and arranged to move the upper holder and the upper platform downward by the upper medium support unit being pulled from above the recording unit.

11. The recording device according to claim 8, wherein the medium support unit has a conveyance mechanism configured and arranged to convey the recording medium to the recording unit.

* * * * *